US012310502B2

(12) United States Patent
Cooper et al.

(10) Patent No.: US 12,310,502 B2
(45) Date of Patent: May 27, 2025

(54) AUTOMATED TASK CHAIR

(71) Applicants: Lloyd Bowers Cooper, Mountain Brook, AL (US); Foster Daniel Phillips, Homewood, AL (US); Larry Todd Wilson, Sewanee, TN (US)

(72) Inventors: Lloyd Bowers Cooper, Mountain Brook, AL (US); Foster Daniel Phillips, Homewood, AL (US); Larry Todd Wilson, Sewanee, TN (US)

(73) Assignee: Push Product Design, LLC, Birmingham, AL (US)

( * ) Notice: Subject to any disclaimer, the term of this patent is extended or adjusted under 35 U.S.C. 154(b) by 0 days.

(21) Appl. No.: 18/093,923

(22) Filed: Jan. 6, 2023

(65) Prior Publication Data

US 2024/0225287 A1 Jul. 11, 2024

(51) Int. Cl.

| | |
|---|---|
| ***A47C 1/032*** | (2006.01) |
| ***A47C 1/036*** | (2006.01) |
| ***A47C 7/36*** | (2006.01) |
| ***A47C 7/38*** | (2006.01) |
| ***A47C 7/50*** | (2006.01) |
| ***A47C 7/52*** | (2006.01) |

(52) U.S. Cl.

CPC ..... *A47C 1/03255* (2013.01); *A47C 7/36* (2013.01); *A47C 7/50* (2013.01); *A47C 7/506* (2013.01); *A47C 7/5066* (2018.08); *A47C 1/036* (2013.01); *A47C 7/38* (2013.01)

(58) Field of Classification Search

CPC ..... A47C 1/03255; A47C 1/036; A47C 7/38; A47C 7/50; A47C 7/506; A47C 7/5066; A61G 15/125

USPC ..... 297/344.1, 344.12, 344.17

See application file for complete search history.

(56) References Cited

U.S. PATENT DOCUMENTS

| | | | | | |
|---|---|---|---|---|---|
| 503,246 | A * | 8/1893 | Mc | 297/423.4 X | |
| 694,538 | A * | 3/1902 | Eddy | A47C 7/506 | 297/423.22 |
| 2,524,187 | A * | 10/1950 | Boles | A47C 1/06 | 248/430 X |
| 2,620,863 | A * | 12/1952 | Cooper | A61B 90/60 | 297/188.2 |
| 3,642,320 | A * | 2/1972 | Ward | A47C 7/5064 | 297/423.37 X |
| 3,820,844 | A * | 6/1974 | Fortnam | A61G 15/14 | 297/423.37 |
| 4,597,356 | A * | 7/1986 | McCaghren | B63H 20/12 | 440/7 |
| 4,767,160 | A * | 8/1988 | Mengshoel | A47C 9/005 | 248/188.7 |
| 4,768,831 | A * | 9/1988 | Liedberg | A47C 9/02 | 297/423.38 X |
| 5,174,631 | A * | 12/1992 | Schaevitz | A47C 7/506 | 248/188.7 |
| 5,255,957 | A * | 10/1993 | Opsvik | A47C 7/503 | 297/423.37 |

(Continued)

FOREIGN PATENT DOCUMENTS

| | | | | |
|---|---|---|---|---|
| CN | 101332024 | A * | 12/2008 | A47C 7/405 |

*Primary Examiner* — Rodney B White

(74) *Attorney, Agent, or Firm* — Nicholas J. Landau; Maynard Nexsen PC

(57) ABSTRACT

An automated task chair with foot support that assists the user in sitting, working and resting in more optimal positions that promote both task effectiveness and user comfort.

12 Claims, 12 Drawing Sheets

(56) References Cited

U.S. PATENT DOCUMENTS 5,765,910 A * 6/1998 Larkin ..... A47B 83/001 297/173
6,634,716 B2 * 10/2003 Sander ..... A47C 7/506 297/423.12
6,648,417 B1 * 11/2003 Gilbert ..... A47C 7/506 297/423.19
7,032,976 B2 * 4/2006 Lin ..... A47C 7/506 297/423.24
7,198,329 B1 * 4/2007 Larson ..... A47C 3/22 297/344.12 X
7,341,310 B1 * 3/2008 Ross ..... A47C 3/36 297/344.12 X
7,452,034 B2 * 11/2008 Jung ..... A47C 7/506 297/423.37 X
8,025,334 B2 * 9/2011 Schmitz ..... A47C 31/126 297/300.1
9,149,678 B2 * 10/2015 Shauli ..... A47C 9/002
9,642,465 B1 * 5/2017 Park ..... A47C 7/506
9,848,705 B2 * 12/2017 Probst ..... A47C 7/006
9,884,200 B2 * 2/2018 Pillutla ..... A61N 2/02
10,219,625 B2 * 3/2019 Probst ..... A47C 7/54
10,405,666 B1 * 9/2019 Reus ..... A47C 9/002
10,653,242 B2 * 5/2020 Ortiz ..... A47C 7/72
10,772,432 B2 * 9/2020 Park ..... A47C 7/5064
11,045,002 B1 * 6/2021 Saperton ..... A47C 7/004
11,129,480 B2 * 9/2021 López Gil ..... A47C 7/506
11,160,382 B2 * 11/2021 Beloff ..... A47C 7/5062
2002/0043841 A1 * 4/2002 Giacinto ..... A47C 7/38 297/284.7
2003/0025374 A1 * 2/2003 Moore ..... A47C 9/022 297/344.12
2003/0173808 A1 * 9/2003 Ruckstadter ..... A47C 1/03294 297/423.27 X
2006/0131942 A1 * 6/2006 King ..... A47C 3/30 297/344.12
2014/0103688 A1 * 4/2014 Wilson ..... A47C 7/46 297/284.7
2015/0257960 A1 * 9/2015 Reyes ..... A47C 20/023 5/611
2017/0197534 A1 * 7/2017 An ..... B60N 2/02246
2023/0232993 A1 * 7/2023 Benden ..... A47C 9/025 297/129

* cited by examiner

AUTOMATED TASK CHAIR

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention is in the technical field of ergonomic seating.

Ergonomics has become an extremely popular subject in relation to all types of products, and to furniture and seating in particular. The word means "the study of people's efficiency in their working environment." The fundamental challenge with chairs is that they force the body into positions in which users remain in relatively fixed positions and do not move for extended periods of time. Throughout history, numerous adjustable chairs have been developed for a wide range of applications—from working to resting to rehabilitation.

More traditional, recent ergonomic chairs, like Aeron and Leap, are based on adjustable seating surfaces that are controlled with knobs, levers, air cylinders and torsion springs. These surfaces can be adjusted to conform to a wide range of body sizes, shapes and weights. While traditional seating supports the body in relatively upright positions, more advanced ergonomic chairs can also support the body in a series of positions ranging from forward tilt/leaning all the way to reclined orientations.

In the field of ergonomics, it is commonly known that no single static position is healthy to maintain over time. The body requires movement to alleviate static loads on bone, muscle and tissue, and to promote circulation and enhance respiration. A challenge with all forms of seating is that users naturally tend to assume positions that require the least amount of effort which result in the greatest levels of perceived comfort. Users naturally assume fixed positions and remain in those positions too long without changing position. One reason users fail to move adequately throughout a sitting period is that they perceive they are comfortable and do not experience enough discomfort to notice they are not in optimal enough positions in relation to the physical stresses that their bodies are experiencing. When users are not aware that their bodies are being stressed, they remain in the same position and do not move.

One of the most common examples of assuming fixed, non-optimal positions for too long a period of time is sitting in reclined orientations without proper spinal support. Users naturally attempt to recline their bodies to dissipate upper body weight onto the back portion of their seats. This weight shift is easier to accomplish the more the body is reclined. As the seat is reclined and more weight is placed on the upper back surface, a shearing action takes place where the user's bottom contacts the seat. This shearing action encourages the user's bottom to slide away from the seat back towards the front of the seat. Shearing occurs because the countering force is limited. The user's feet and legs provide limited resistive force to this action because the user's feet tend to rest unevenly on the floor, the user's knees are bent, and the legs and feet are not in optimal positions to provide countering leverage. Even if the user's feet are firmly planted on the floor, a chair on casters will simply roll backward away from the user's foot placement on the floor.

Conventional chairs do not include any form of integrated foot support to counter the this shearing action or to counter the unbalanced condition that results when users place too much of their body weight onto the back of the seat when they recline.

Conventional chairs require the user to engage their legs to partially stand up out of the seat in order to raise the height of the seat because conventional gas pistons or simple springs located in the seat base cannot generate enough force to lift the user's entire weight.

While some conventional chairs allow the user to adjust the seat recline mechanism by adjusting spring tension in the mechanism to counter a portion of their body weight, these mechanisms are limited in their ability to support a more extended range of travel from a fully reclined seating orientation to a fully raised and sit-stand seating orientation.

SUMMARY OF THE INVENTION

Disclosed herein is a novel device that provides the ability to support the user more effectively in seated positions and to assist the user in altering their positions over time into a range of more optimal body support postures that are best suited to their particular activity while seated.

The ATC includes an integrated footplate support that is coupled to the seat structure to provide a stable surface to support the user's feet and legs and to counter the shearing action described in the background.

One embodiment of the invention includes a footrest support structure that can be temporarily or permanently attached to locations on an existing chair structure, including the vertical axis extending from the seat base.

A further embodiment incorporates a footplate that is integrated into an alternate design for a seat base structure. Both embodiments could include a fixed footplate angle. Both embodiments could also include a mechanical linkage means or powered means to automatically adjust the angle of the footplate support structure as a function of the seat orientation. The range of inclination of the footplate could be from a lowered position that is flat or parallel to the floor plane, all the way to a raised position that approaches an angle approximately 45 degrees to the floor plane. The mechanical linkage means could be in the form of pulleys and cables. The powered means could be in the form of a rotary or linear electric, pneumatic or hydraulic actuator. The distance between the footplate and the seat could be fixed or an adjustable slide means could be provided to change this distance.

A further embodiment of the ATC incorporates powered actuators to allow the user to manually adjust the footplate, seat, armrest and headrest surfaces over a wider range of positions than would normally be possible with conventional chairs that use only springs and pneumatic pistons for adjustment.

A further embodiment of the ATC uses a powered seat angle actuator to control the seat angle adjustment mechanism that includes a spring means which could be a torsion spring. As noted in the background, conventional chairs allow the user to adjust the seat recline mechanism by adjusting spring tension to counter a portion of their body weight. By using a powered actuator to control the tension load on the torsion spring, the seat angle can be adjusted through a more extended range of travel from a fully reclined seating orientation to a forward-tilt seating orientation. By combining the powered actuator with a spring-based mechanism, the user is able to sit in stable position angle ranges while still being able to dynamically move up/forward or down/reclined as function of spring tension. Angle ranges may vary+/− one to ten degrees, or more.

A further embodiment of the ATC is to incorporate a control system that can automatically adjust the seating surfaces utilizing the powered actuators based on inputs that are provided by data from sensors that are built into the chair structure and/or logic/computer programs that operate the control system.

The control system could include a PLC or other computer device. Angle sensors could include inclinometers and axial accelerometers. Pressure sensors could include pressure pads, pressure plates and strain gauges.

These powered embodiments could include electric linear and/or rotary actuators, a battery or non battery power source and an integrated control source such as a PLC, all attached/integrated to the chair, or a non integrated control source such as the user's smart phone.

Automated motion control could be programmed in a variety of ways. One example of automated movement is to automatically change the seat angle of inclination in relation to the ground plane between two extreme ranges, e.g. forward-tilt to full recline, at a controlled rate of change over a given time period.

An advanced example of automated motion could us axial accelerometer sensors that measure the position of the user's body elements, e.g. feet, legs, trunk, torso, arms, head, and the associated pressures that these body elements are exerting on their corresponding support surfaces using strain gauges sensors. Automated motion could be programmed based on recognizing when pressures exceeded defined levels at given positions and adjusting these support surfaces to achieve new position and pressure values that have been defined as being in more optimal ranges. Automated motion could also be programmed based on recognizing when the time duration for a given position exceeded defined time limits and then adjusting chair support surfaces to achieve new positions.

An additional advanced automated motion control capability is based on initially defining optimal seating component spatial relationships based on inputing or measuring the user's specific physical size and weight. Once these inputs are made, the ATC automatically adjusts the relative relationship between certain components, e.g., headrest and seat back, as the user changes seating angle. Instead of having to manually readjust the key relationships of the headrest, arm support and seat height as the user moves from forward-tilt to reclined postures, the adjustments could be made automatically as the user performs a single selected action, e.g. leaning back in the seat.

An additional automated motion control capability is based on analyzing data from sensors that have monitored a range of different users performing similar tasks. This data could include biometric data e.g., respiration and heart rate, and seating support component position data from users as they engage in different seated activities, e.g., resting, reading, working on computer devices, writing, designing, programming, other, etc. Seating position, activity efficiency and biometric data could be analyzed in a comparative fashion. More optimal seating orientations could be identified that maximize activity efficiency. The user could then enter preference settings into the control system to instruct the control system to automatically encourage seating orientations that help the user achieve their activity goals while minimizing physical stress, e.g., minimizing excessive pressure loading in key areas of the neck, back, armrest, seat and feet while maximizing respiration and blood circulation.

An additional automated motion control analysis capability could be to provide visual or tactile feedback to the user based on their body position. The user could be provided with an indication that they are in an optimal posture range. Or, if the control system observes that the user is in non optimal positions or postures, the system could alert the user. Visual feedback could include status lights or a graphical interface displayed on the screen of an electronic device. Tactile feedback could be provided by means including haptic motors.

An additional automated motion control capability could allow users to shift their body position to direct the chair to move into predefined positions. These shifts in position could be used to trigger an action based on specific, predefined sensor readings. For example, if the user leaned forward and certain angle limit ranges were achieved, the seat could automatically raise and tilt forward more while keeping the head to headrest and arm to armrest relationships in optimal, predefined spacial relationships. The control system could also detect when the user leaned backward. If certain angle limit ranges were achieved, the control system could provide augmentative power to the actuators to recline the seat and to lower the chair even further.

An additional automated motion control capability could enable users to use voice commands to direct the chair to move into predefined positions.

An additional automated sensor and motion control system capability could be the ability to measure proper spinal posture. By sitting in the ATC in a reclined orientation, the chair could measure the user's weight distribution along the cervical, thoracic, lumbar, ischial/pelvis and footplate surfaces. By comparing this pressure data to other users of similar weight and height who were measured in known surface orientations, the user's approximate spinal posture could be inferred and determined. By entering this data into the control system, the control system could then determine when the user was sitting in non optimal, compromised spinal posture. The control system could then make automated seat adjustments using the seat component actuators to encourage the user back into more optimal postures that promoted proper spinal support.

Because conventional seat angle mechanisms based on torsion springs and pneumatic pistons are limited in their ability to support a more extended range of travel from a fully reclined seating orientation to a fully raised and sit-stand seating orientation, the sensors, powered actuator and control system in the ATC could assist the user in moving user through a much larger range of seat angle and seat height adjustments with less physical exertion.

The ATC provides the potential upsides of offering a seating system that assists the user in sitting, working and resting in more optimal orientations that promote both task efficiency and user health. The ATC does not have any known downside.

BRIEF DESCRIPTION OF THE DRAWINGS

Key components are numbered as follows: footplate (1), seat base (2), seat base vertical axis (3), seat base vertical axis actuator (4), seat angle adjustment mechanism (5), seat angle actuator (6), seat pan (7), armrest (8), armrest actuator (9), seat back (10), headrest (11), headrest adjustment mechanism (13), headrest height actuator (14), footplate pivot axis (15), footplate adjustment mechanism (15), footplate glides (16), footplate wheels (17), torsion spring (18), seat sensors (19), foot support securing element (20), foot support structure (21), foot support securing element flat (22), and foot support securing element connector (23).

DETAILED DESCRIPTION OF THE INVENTION

Figure 1:
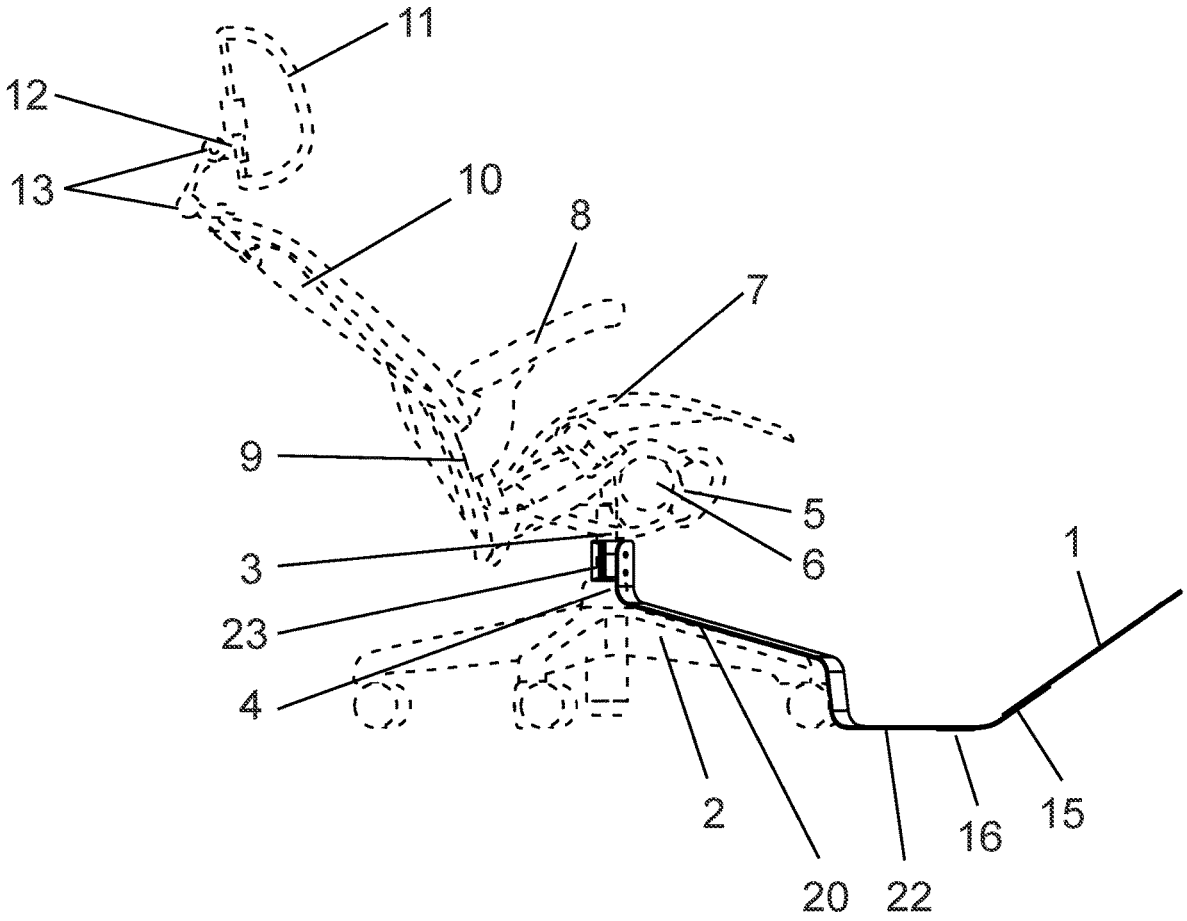
FIG. 1 is a side view of the separate footrest support device attached to a standard task chair.
Figure 2:
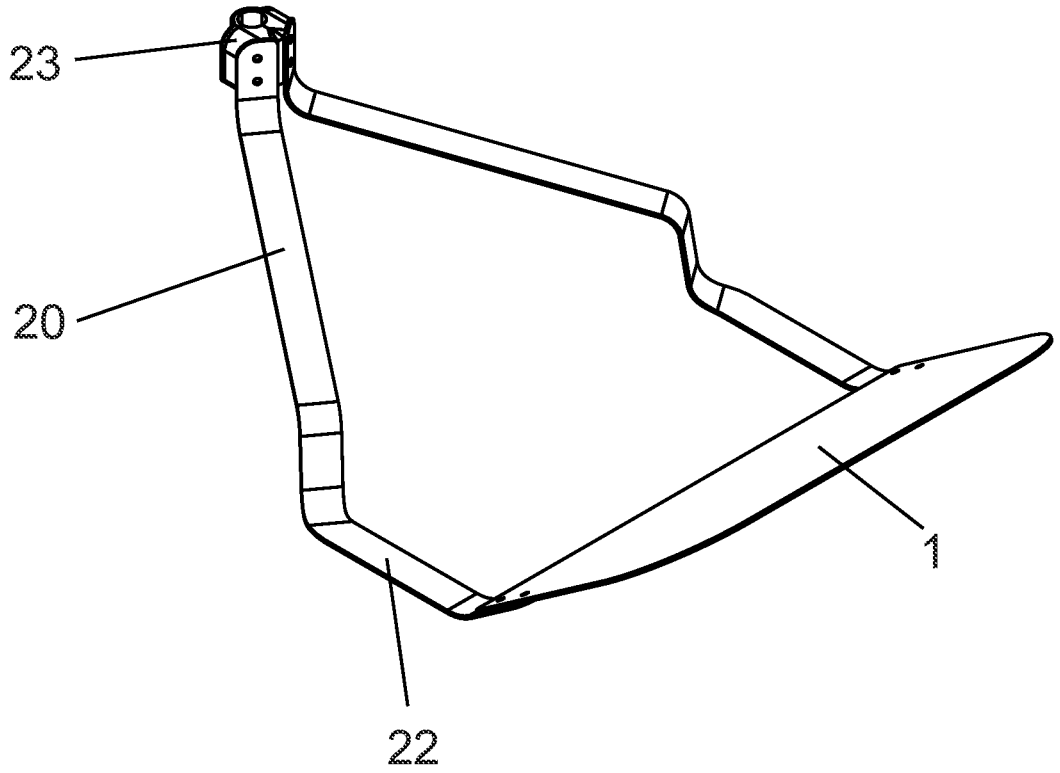
FIG. 2 is an orthographic view of the separate footrest support device.
Figure 3:
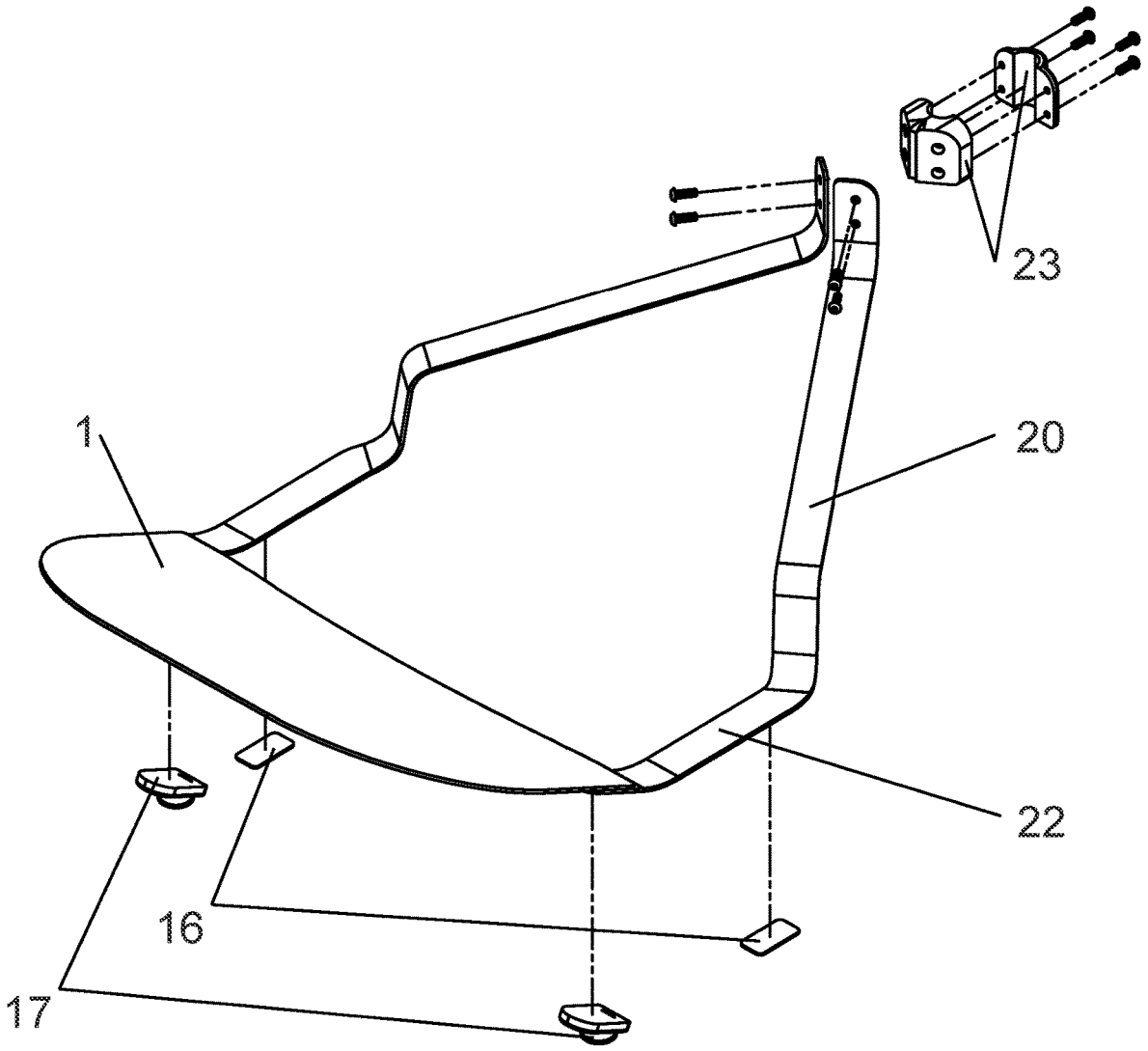
FIG. 3 is an exploded orthographic view of the separate footrest support device
Figure 4:
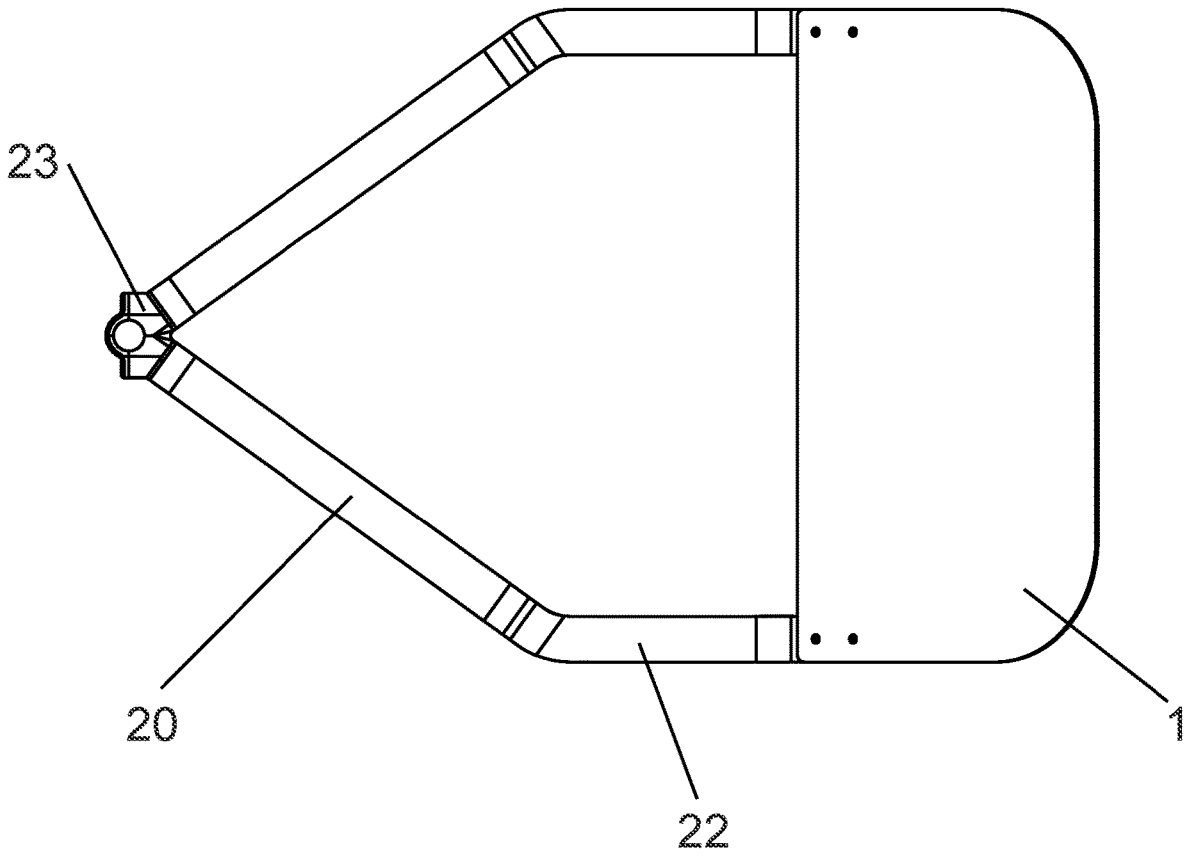
FIG. 4 is a top view of the separate footrest support device.
Figure 5:
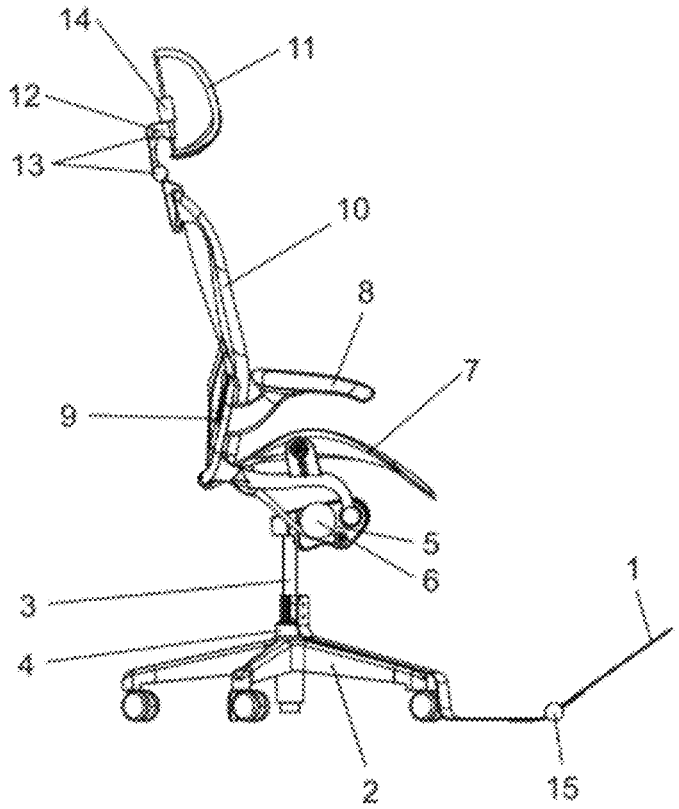
FIG. 5 is a side view of the device with the seat in an upright, forward-tilt position.
Figure 6:
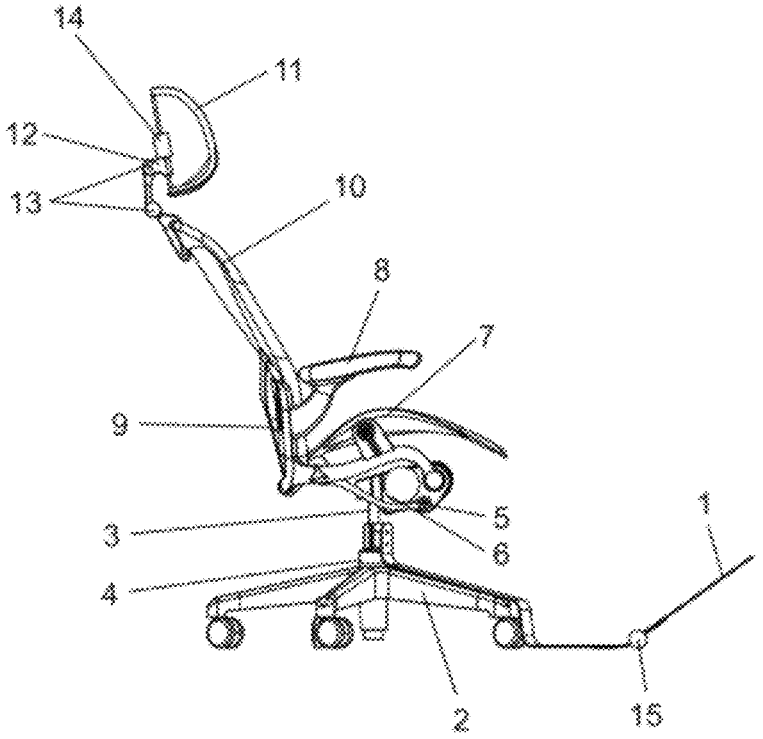
FIG. 6 is a side view of the device with the seat in semi-reclined position.
Figure 7:
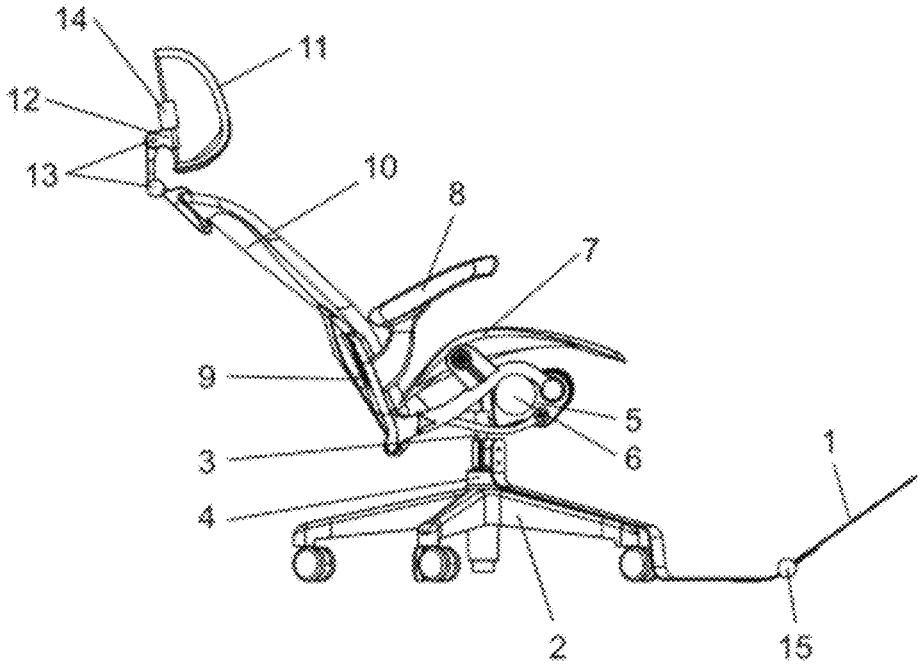
FIG. 7 is a side view of the device with the seat in full reclined position.
Figure 8:
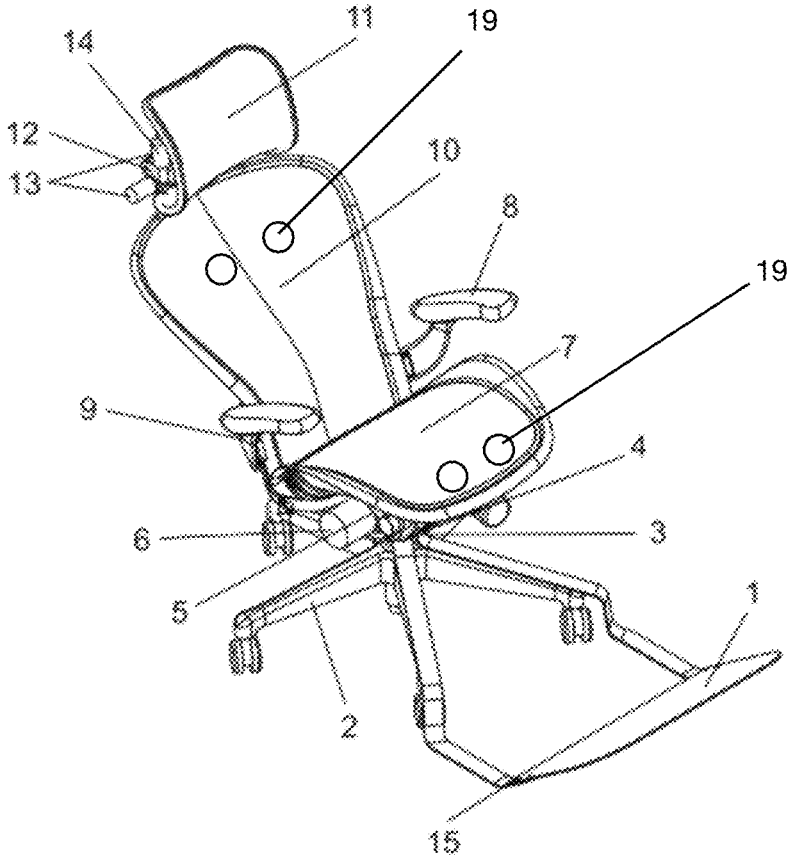
FIG. 8 is an orthographic view of the device with the seat in reclined position.
Figure 9:
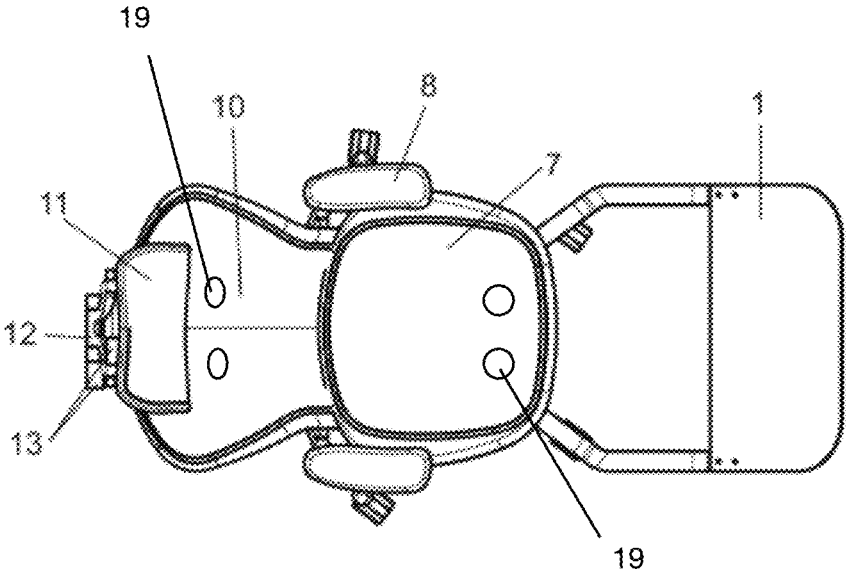
FIG. 9 is a top view of the device with the seat in reclined position.
Figure 10:
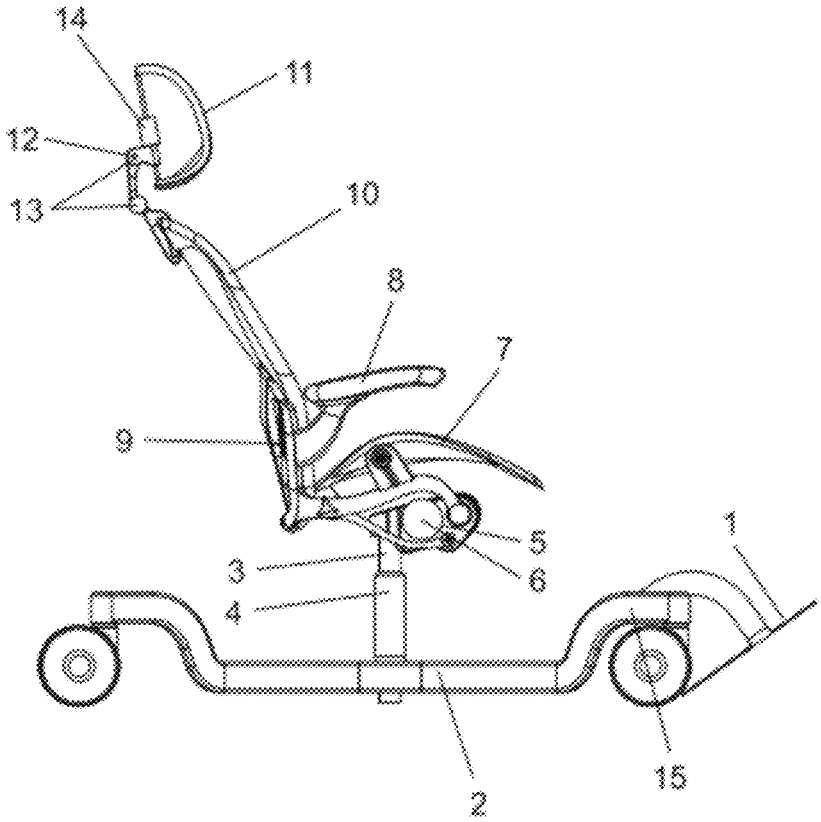
FIG. 10 is side view of the device with an alternative base
Figure 11:
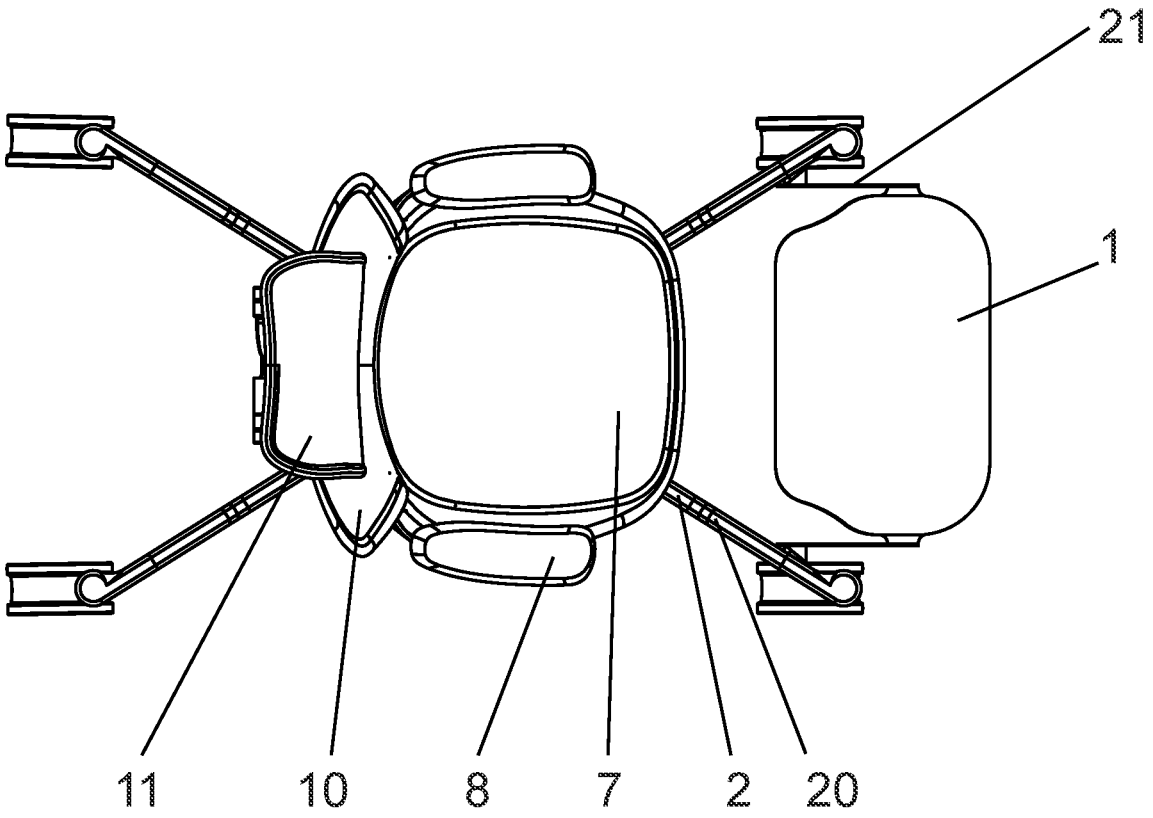
FIG. 11 is a top view of the device with an alternative base
Figure 12:
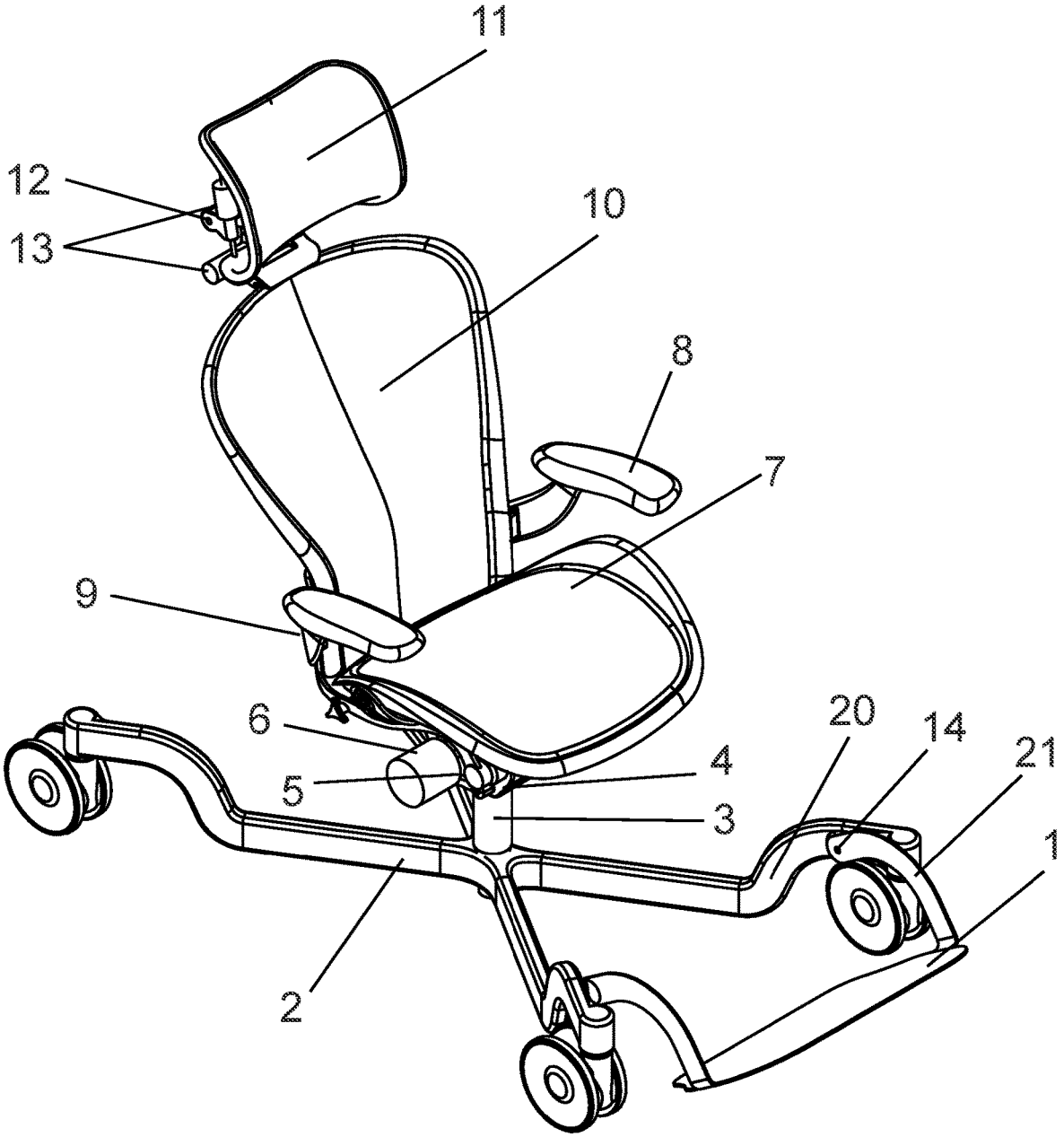
FIG. 12 is an orthographic view of the device with an alternative base
Figure 13:
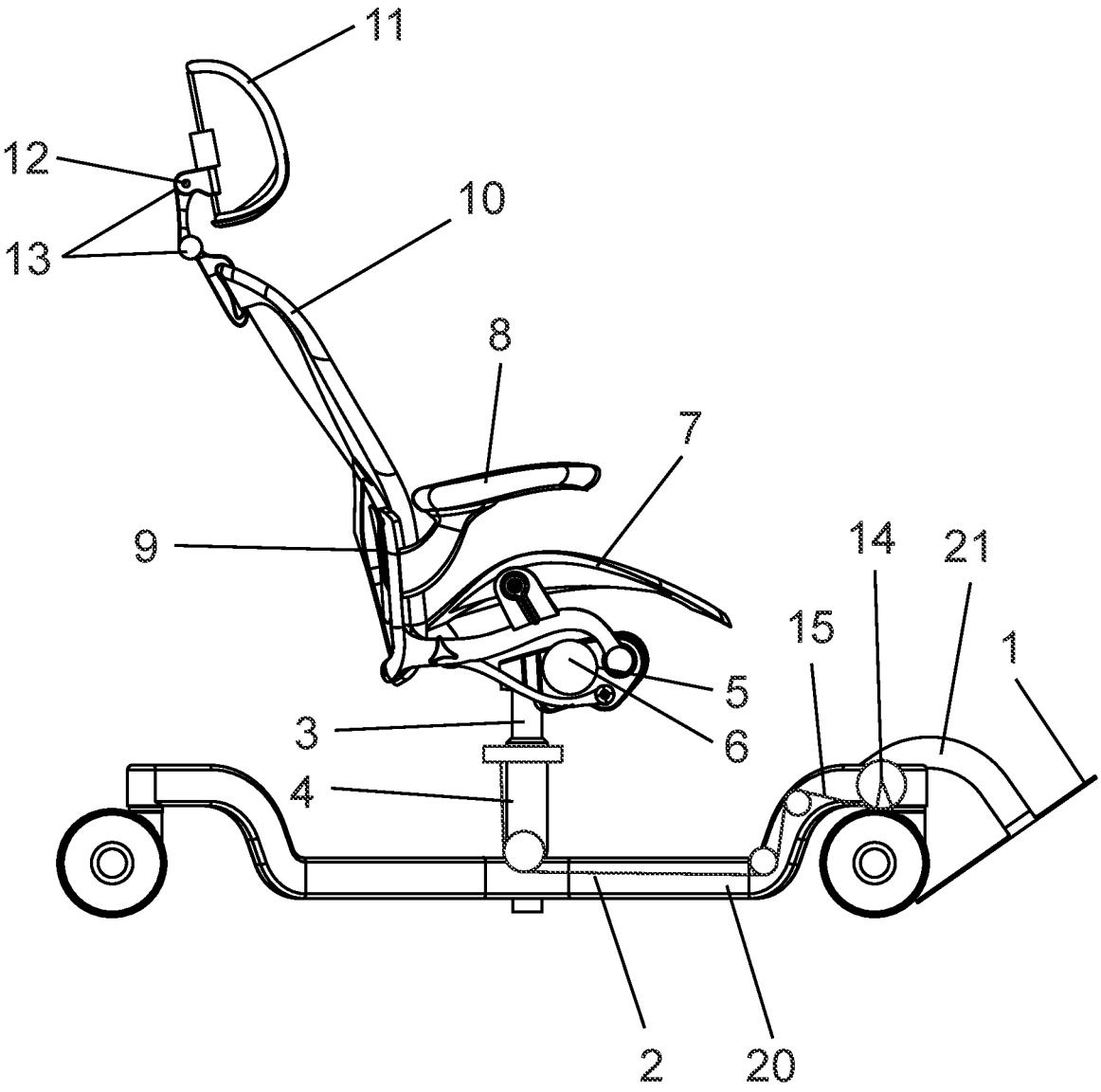
FIG. 13 is a side view of the device with an alternative base with a cable and pulley-based mechanism linkage that rotates the footplate automatically as the seat is raised or lowered
Figure 14:
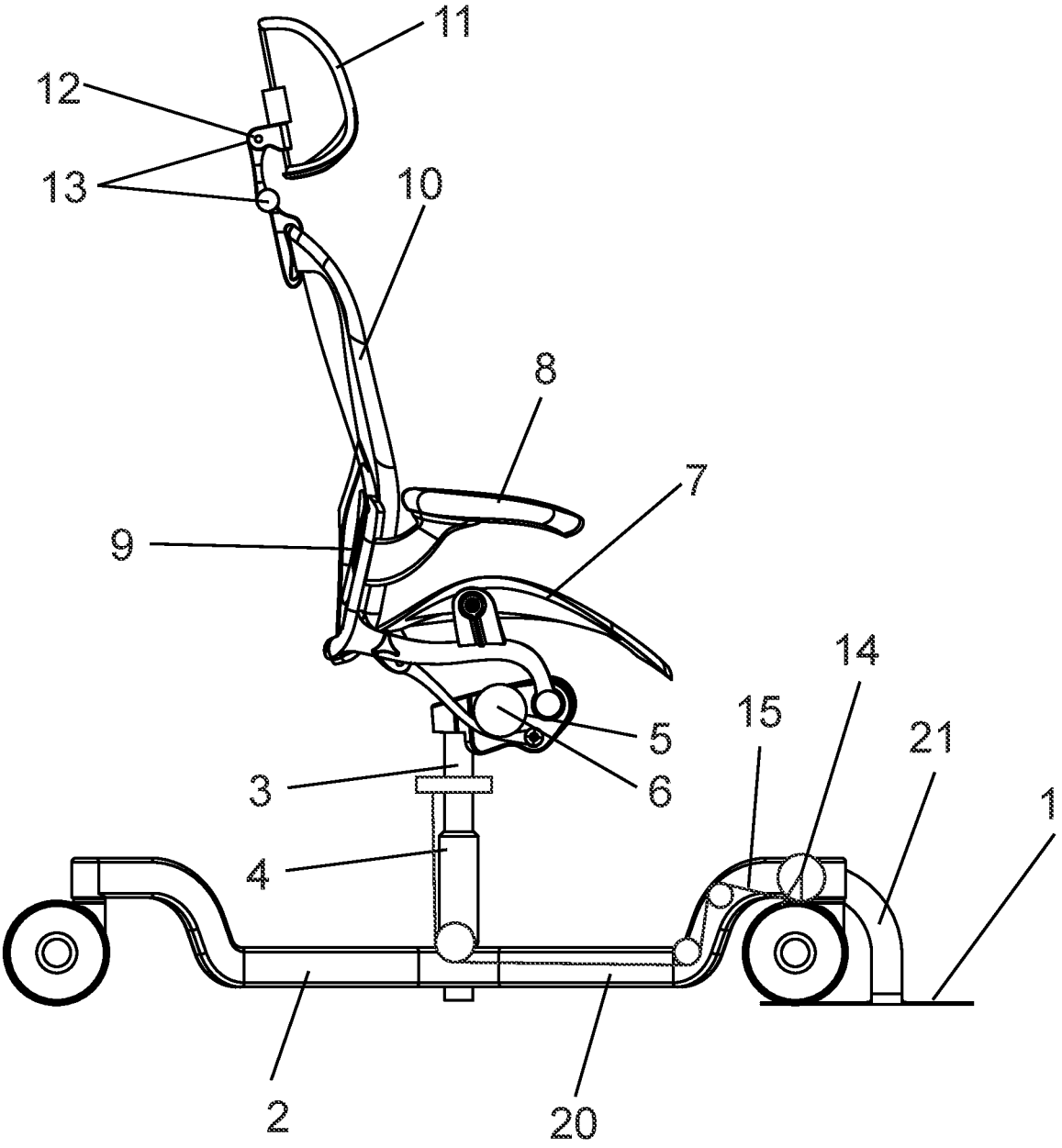
FIG. 14 is a side view of the device with an alternative base with a mechanism linkage that has rotated the footplate flush with the ground plane when the seat is raised
Figure 15:
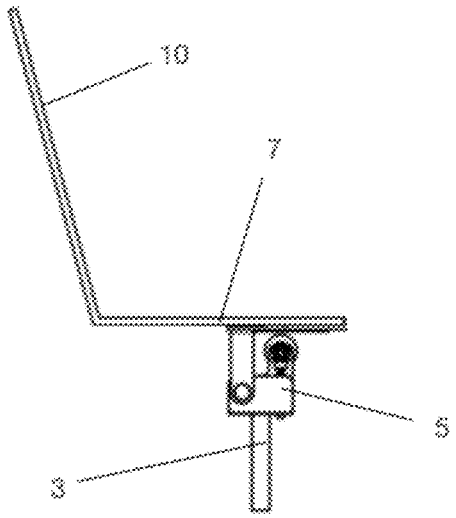
FIG. 15 is a simplified side view of the upper portion of a chair and seat angle adjustment mechanism in an upright position
Figure 16:
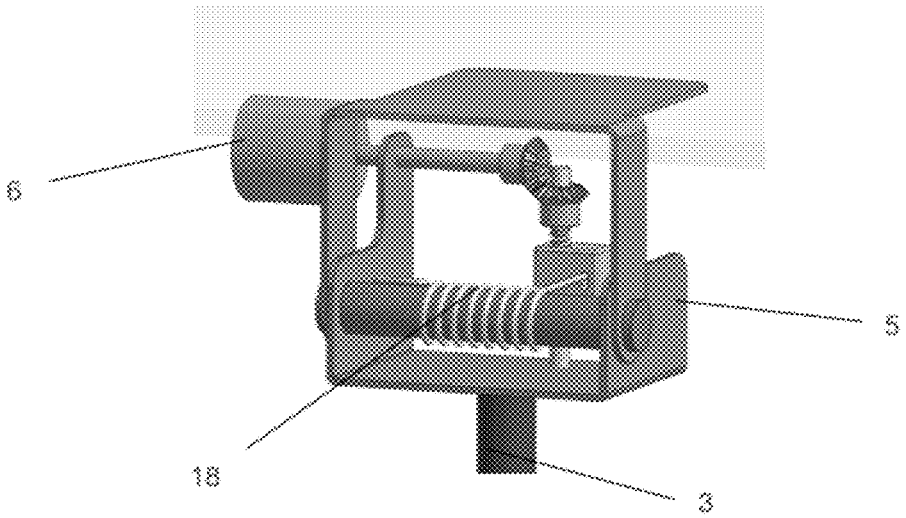
FIG. 16 is a simplified orthographic detail view of a seat angle adjustment mechanism incorporating a torsion spring and seat angle actuator in an upright orientation

The components of the Automated Task Chair (ATC) include some or all of the following:

- Seat base means to support the seat structure
- Footplate means to support the user's feet and legs
- Seat vertical axis means to raise or lower the entire seat structure.
- Seat base vertical axis actuator means to raise or lower the seat
- Seat angle adjustment mechanism means to change the angle of the seat
- Seat angle adjustment mechanism actuator means to change the angle of the seat
- Seat pan means to support the user's bottom/pelvis
- Armrest means to support the user's arms
- Armrest actuator means to raise or lower the arm support
- Seat back means to support the user's back
- Headrest means to support the user's head
- Headrest adjustment means to change the headrest position
- Headrest angle actuator means to change the headrest angle
- Headrest height actuator means to change the headrest height
- Footplate adjustment mechanism to change the footplate position
- Footplate actuator to change the footplate position and/or angle
- Sensor means to measure the position of relative seat components
- Sensor means to measure the pressure of the user's body at various points as it contacts the seating surfaces
- Control system means to receive data from the sensors, run programs and provide powered and/or automated movements by controlling the different actuators in the ATC Additional potential embodiments of the device include:

- Control system means integrated into chair
- Control system means integrated into device that is separate from chair
- Control system integrated into smart device, e.g., mobile phone, computer
- Control system integrated into wearable device

What is claimed is:

1. A foot support for a seating device, wherein the seating device comprises a seat base with multiple legs capable of supporting the seating device on a floor, a seat pan, and a vertical column that supports the seat pan and defines a vertical axis about which the seat pan pivots, the foot support comprising a support surface positioned in front of the seating device and adapted to receive the bottom surface of a seated user's feet;

a first securing element to attach said support surface to column of said seating device; and a second securing element to attach said support surface to the vertical column of said seating device;

wherein the first securing element and the second securing element are configured to allow the foot support to pivot about the vertical axis;

wherein the multiple legs of the seat base extend from the vertical column at a first angle relative to one another; and wherein the first securing element and the second securing element are configured to extend from the vertical column at a second angle from one another that is about equal to the first angle.

2. The foot support of claim 1, wherein at least a portion of one or both of the first securing element and the second securing element is parallel and proximate to the floor.

3. The foot support of claim 2, comprising a low friction element on the portion that is parallel and proximate to the floor which is in contact with the floor and thus enables said foot support to be pivoted with minimal user effort.

4. The foot support of claim 1, wherein the support surface is substantially angled upward.

5. The foot support of claim 4, comprising an angle adjustment means that enables the support surface to be lowered flat to the floor, or set to any position from being substantially upward to flat on the floor.

6. A seating device comprising the foot support of claim 1, further comprising a powered actuator that assists in raising or lowering the seating device along said vertical axis.

7. The seating device of claim 6, wherein the seating surface comprises sensors that act to control said actuator to either raise or lower said seating device along said vertical axis.

8. A seating device comprising the foot support of claim 1, the seating device comprising a powered actuator that assists in rotating the seating angle rearward or forward.

9. The seating device of claim 8, wherein the seating surface comprises as sensors that act to control said actuator to either recline or tilt said seating device into a forward-tilt orientation.

10. A seating device comprising the foot support of claim 1, the seating device further comprising a headrest and a powered headrest actuator that assists in adjusting a position of the headrest in relation to the seating surface.

11. The seating device of claim 10, wherein the seating surface comprises sensors that act to control said actuator to adjust the headrest forward or rearward in relation to the seating surface.

12. The seating device of claim 1, wherein the seat base comprises five legs that are equally spaced and extend from the vertical column at the first angle relative to one another.

* * * * *